US010907414B2

(12) United States Patent
Schoen

(10) Patent No.: US 10,907,414 B2
(45) Date of Patent: Feb. 2, 2021

(54) EARTH BORING TOOLS HAVING FIXED BLADES AND VARYING SIZED ROTATABLE CUTTING STRUCTURES AND RELATED METHODS

(71) Applicant: Baker Hughes, a GE company, LLC, Houston, TX (US)

(72) Inventor: William Schoen, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 294 days.

(21) Appl. No.: 15/807,853

(22) Filed: Nov. 9, 2017

(65) Prior Publication Data

US 2019/0136633 A1 May 9, 2019

(51) Int. Cl.

| | |
|---|---|
| ***E21B 10/14*** | (2006.01) |
| ***E21B 10/56*** | (2006.01) |
| ***E21B 10/43*** | (2006.01) |
| ***E21B 10/42*** | (2006.01) |
| ***E21B 10/16*** | (2006.01) |

(52) U.S. Cl.
CPC ..... *E21B 10/14* (2013.01); *E21B 10/56* (2013.01)

(58) Field of Classification Search
CPC ..... E21B 10/14; E21B 10/56; E21B 10/43; E21B 10/42
See application file for complete search history.

(56) References Cited

U.S. PATENT DOCUMENTS

| | | | | |
|---|---|---|---|---|
| 4,763,736 | A | 8/1988 | Varel, Sr. | |
| 9,316,058 | B2 | 4/2016 | Bilen et al. | |
| 9,556,681 | B2 | 1/2017 | Kulkarni | |
| 2011/0079442 | A1 * | 4/2011 | Buske | E21B 10/28 175/336 |

(Continued)

FOREIGN PATENT DOCUMENTS

| | | | |
|---|---|---|---|
| CN | 106194033 A | 12/2016 | |
| WO | WO-2008124572 A1 * | 10/2008 | E21B 10/14 |

OTHER PUBLICATIONS

International Search Report for International Application No. PCT/US2018/060017 dated Mar. 8, 2019, 3 pages.

(Continued)

*Primary Examiner* — David J Bagnell
*Assistant Examiner* — Manuel C Portocarrero
(74) *Attorney, Agent, or Firm* — TraskBritt

(57) ABSTRACT

An earth-boring tool includes a body, a plurality of blades attached to the body and extending at least to a nose region of the earth-boring tool, a first rotatable cutting structure assembly coupled to the body, and a second rotatable cutting structure assembly coupled to the body. The first rotatable cutting structure assembly includes a first leg and a first rotatable cutting structure rotatably coupled to the first leg. A first cutting profile of the first rotatable cutting structure extends at least from a gage region of the earth-boring tool and at least partially through a cone region of the earth-boring tool. The second rotatable cutting structure assembly includes a second leg and a second rotatable cutting structure rotatably coupled to the second leg. A second cutting profile of the second rotatable cutting structure extends only from the gage region of the earth-boring tool and to an innermost boundary of a nose region of the earth-boring tool.

19 Claims, 7 Drawing Sheets

(56) References Cited

U.S. PATENT DOCUMENTS

| | | | |
|---|---|---|---|
| 2014/0151131 | A1 | 6/2014 | Zahradnik et al. |
| 2016/0108680 | A1 | 4/2016 | Rothe |
| 2017/0175450 | A1 | 6/2017 | Poteet, III |

OTHER PUBLICATIONS

International Written Opinion for International Application No. PCT/US2018/060017 dated Mar. 8, 2019, 6 pages.

Lenamond et al., Performance Gains for Rotary Steerable Through Specialized Bit Design, American Association of Drilling Engineers, AADE-05-NTCE-46, presented at the AADE National Technical Conference and Exhibition, Houston, Texas, Apr. 5-7, 2005, 14 pages.

* cited by examiner

EARTH BORING TOOLS HAVING FIXED BLADES AND VARYING SIZED ROTATABLE CUTTING STRUCTURES AND RELATED METHODS

TECHNICAL FIELD

This disclosure relates generally to earth boring tools having rotatable cutting structures. This disclosure also relates to earth-boring tools having blades with fixed cutting elements as well as rotatable cutting structures mounted to the body thereof.

BACKGROUND

Oil and gas wells (wellbores) are usually drilled with a drill string. The drill string includes a tubular member having a drilling assembly that includes a single drill bit at its bottom end. The drilling assembly may also include devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit and/or reamer attached to the bottom end of the drilling assembly is rotated by rotating the drill string from the drilling rig and/or by a drilling motor (also referred to as a "mud motor") in the bottom hole assembly ("BHA") to remove formation material to drill the wellbore.

BRIEF SUMMARY

Some embodiments of the present disclosure include earth-boring tools. The earth-boring tools may include a body, a plurality of blades protruding from the body and extending at least from a gage region of the earth-boring tool to nose region of the earth-boring tool, a first rotatable cutting structure assembly coupled to the body and a second rotatable cutting structure assembly coupled to the body. The first rotatable cutting structure assembly may include a first leg extending from the body of the earth-boring tool and a first rotatable cutting structure rotatably coupled to the first leg, wherein a first cutting profile of the first rotatable cutting structure extends at least from the gage region of the earth-boring tool and at least partially through a cone region of the earth-boring tool. The second rotatable cutting structure assembly may include a second leg extending from the body of the earth-boring tool and a second rotatable cutting structure rotatably coupled to the second leg, wherein a second cutting profile of the second rotatable cutting structure extends only from the gage region of the earth-boring tool and to an innermost boundary of a nose region of the earth-boring tool.

In additional embodiments, the earth-boring tool may include a body, a plurality of blades protruding from the body and extending at least from a gage region of the earth-boring tool and to a nose region of the earth-boring tool, a first rotatable cutting structure assembly coupled to the body and a second rotatable cutting structure assembly coupled to the body. The first rotatable cutting structure assembly may include a first leg and a first rotatable cutting structure rotatably coupled to the first leg, wherein the first rotatable cutting structure has a first longitudinal length. The second rotatable cutting structure assembly may include a second leg and a second rotatable cutting structure rotatably coupled to the second leg, wherein the second rotatable cutting structure has a second longitudinal length, and wherein a ratio of the first longitudinal length of the first rotatable cutting structure and the second longitudinal length is within a range of about 1.2 and about 1.6.

Some embodiments of the present disclosure include a method of forming an earth-boring tool. The method may include forming a body of the earth-boring tool comprising a plurality of blades, coupling a first rotatable cutting structure to a first leg of a first rotatable cutting structure assembly of the earth-boring tool, the first rotatable cutting structure having a first longitudinal length; and coupling a second rotatable cutting structure to a second leg of a second rotatable cutting structure assembly of the earth-boring tool, the second rotatable cutting structure having a second longitudinal length, wherein a ratio of the first longitudinal length of the first rotatable cutting structure and the second longitudinal length is within a range of about 1.2 and about 1.6.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
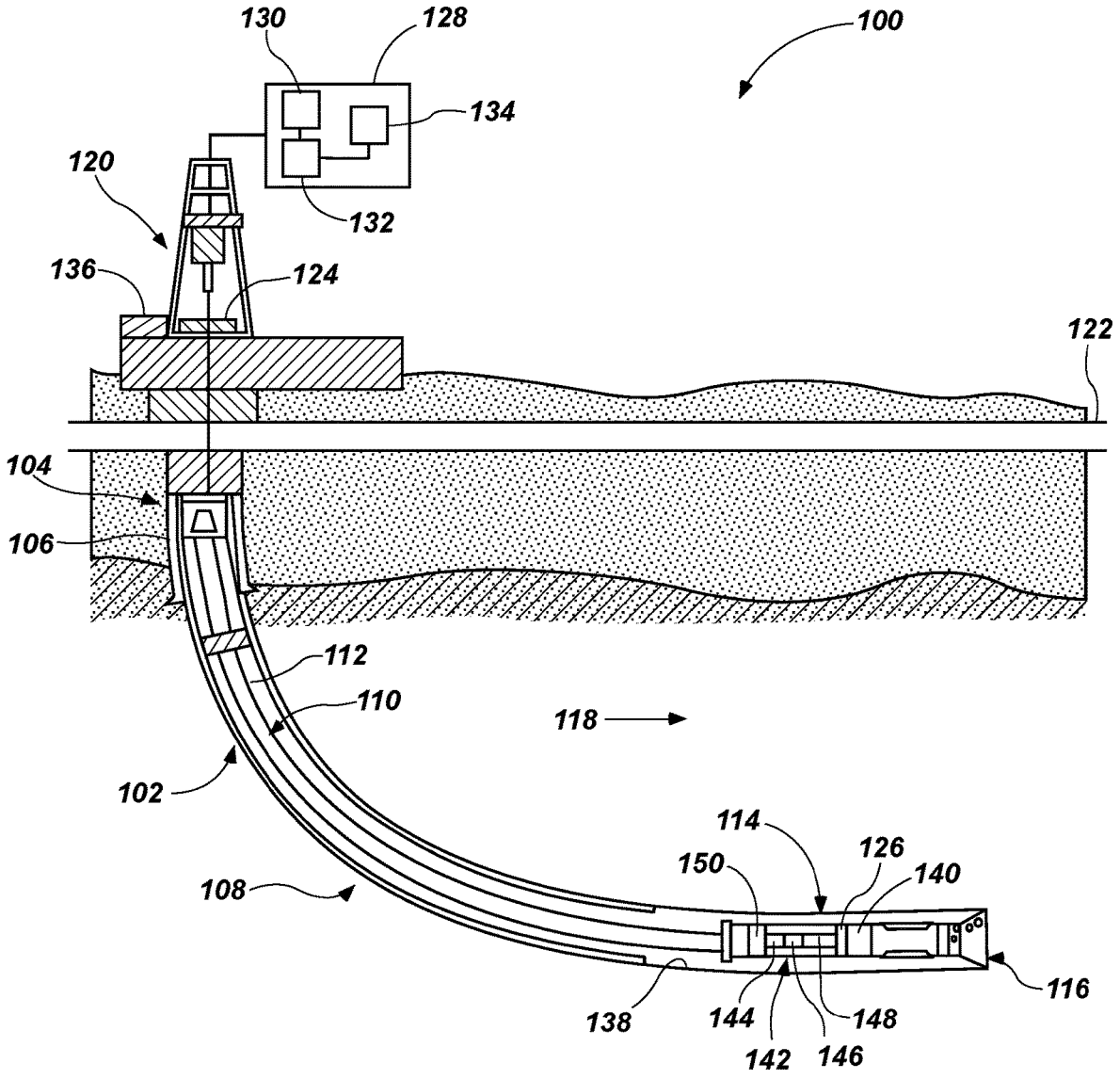
FIG. 1 is a schematic diagram of a wellbore system comprising a drill string that includes an earth-boring tool according to one or more embodiments of the present disclosure.

The illustrations presented herein are not actual views of any drill bit, roller cutter, or any component thereof, but are merely idealized representations, which are employed to describe the present invention.

As used herein, the terms "bit" and "earth-boring tool" each mean and include earth-boring tools for forming, enlarging, or forming and enlarging a borehole. Non-limiting examples of bits include fixed-cutter (drag) bits, fixed-cutter coring bits, fixed-cutter eccentric bits, fixed-cutter bi-center bits, fixed-cutter reamers, expandable reamers with blades bearing fixed-cutters, and hybrid bits including both fixed-cutters and rotatable cutting structures (roller cones).

As used herein, the term "cutting structure" means and includes any element that is configured for use on an earth-boring tool and for removing formation material from the formation within a wellbore during operation of the earth-boring tool. As non-limiting examples, cutting structures include rotatable cutting structures, commonly referred to in the art as "roller cones" or "rolling cones."

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to rotatable cutting structures, such as roller cones.

As used herein, any relational term, such as "first," "second," "top," "bottom," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool when as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Some embodiments of the present disclosure include a hybrid earth-boring tool having both blades and rotatable cutting structures. In particular, the earth-boring tool may include a plurality of blades, a first rotatable cutting structure assembly, and a second rotatable cutting structure assembly. In some embodiments, a first rotatable cutting structure of the first rotatable cutting structure assembly may extend from a gage region of the earth-boring tool and at least partially through a cone region of the earth-boring tool. In other words, the first rotatable cutting structure may extend to a centerline of the tool, or "to center." Moreover, a second rotatable cutting structure of the second rotatable cutting structure assembly may extend from the gage region of the earth boring tool and only to a location proximate to an innermost boundary of a nose region of the earth-boring tool. In one or more embodiments, of the plurality of blades, at least two blades may extend to center, at least one blade may extend through the nose region of the earth-boring tool, and at least two blades may extend through a shoulder region of the earth-boring tool.

One or more embodiments of the present disclosure include a hybrid earth-boring tool having a first rotatable cutting structure having a first longitudinal length and a second rotatable cutting structure having a second longitudinal length. The first longitudinal length of the first rotatable cutting structure may be greater than the second longitudinal length of the second rotatable cutting structure. For example, a ratio of the first longitudinal length L1 to the second longitudinal length L2 may be about 1.4. Moreover, the first rotatable cutting structure may be larger by volume than the second rotatable cutting structure by volume. For example, the first rotatable cutting structure may be about 8% larger than the second rotatably cutting structure by volume.

FIG. 1 is a schematic diagram of an example of a drilling system 100 that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the borehole 102 of a selected diameter in a formation 118.

The drill string 110 may extend to a rig 120 at surface 122. The rig 120 shown is a land rig 120 for ease of explanation. However, the apparatuses and methods disclosed equally apply when an offshore rig 120 is used for drilling boreholes under water. A rotary table 124 or a top drive may be coupled to the drill string 110 and may be utilized to rotate the drill string 110 and to rotate the drilling assembly 114, and thus the drill bit 116 to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a Flash memory, a magnetic tape, a hard disk, and an opticaldisc. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank and/or crown of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

Figure 2:
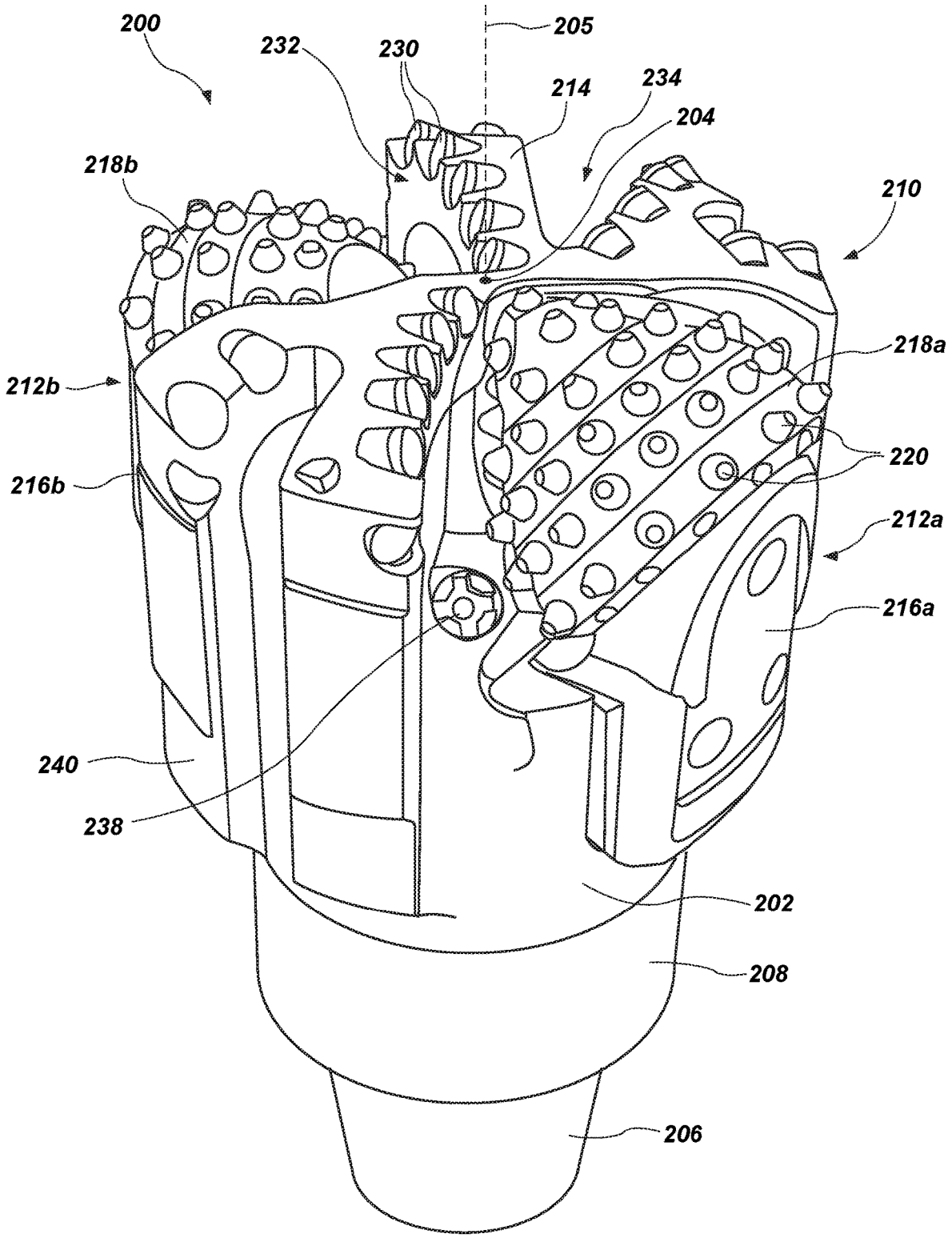
FIG. 2 is a bottom perspective view of an earth-boring tool according to one or more embodiments of the present disclosure.

FIG. 2 is a bottom perspective view of an earth-boring tool 200 that may be used with the drilling assembly 114 of FIG. 1 according to one or more embodiments of the present disclosure. The earth-boring tool 200 may comprise a drill bit having a plurality of rotatable cutting structures in the form of roller cones and one or more blades. For example, the earth-boring tool 200 may be a hybrid bit (e.g., a drill bit having both roller cones and blades) as shown in FIG. 2. Furthermore, the earth-boring tool 200 may include any other suitable drill bit or earth-boring tool 200 having the plurality of rotatable cutting structures and one or more blades for use in drilling and/or enlarging a borehole 102 in a formation 118 (FIG. 1).

The earth-boring tool 200 may comprise a body 202 including a pin 206, a shank 208, and a crown 210. In some embodiments, the bulk of the body 202 may be constructed of steel, or of a ceramic-metal composite material including particles of hard material (e.g., tungsten carbide) cemented within a metal matrix material. The body 202 of the earth-boring tool 200 may have an axial center 204 defining a center longitudinal axis 205 that may generally coincide with a rotational axis of the earth-boring tool 200. The center longitudinal axis 205 of the body 202 may extend in a direction hereinafter referred to as an "axial direction."

The body 202 may be connectable to a drill string 110 (FIG. 1). For example, the pin 206 of the body 202 may have a tapered end having threads thereon for connecting the earth-boring tool 200 to a box end of a drilling assembly 114 (FIG. 1). The shank 208 may include a straight section of constant diameter that is fixedly connected to the crown 210 at a joint. In some embodiments, the crown 210 may include a plurality of rotatable cutting structure assemblies 212 and a plurality of blades 214.

Each blade 214 of the plurality of blades 214 of the earth-boring tool 200 may include a plurality of cutting elements 230 fixed thereto. The plurality of cutting elements 230 of each blade 214 may be located in a row along a profile of the blade 214 proximate a rotationally leading face 232 of the blade 214. In some embodiments, a plurality of cutting elements 220 of a plurality of rotatable cutting structures 218 (e.g., roller cutters) and the plurality of cutting elements 230 of the plurality of blades 214 may include polycrystalline diamond compact (PDC) cutting elements. Moreover, the plurality of cutting elements 220 of the plurality of rotatable cutting structures 218 and the plurality of cutting elements 230 of the plurality of blades 214 may include any suitable cutting element configurations and materials for drilling and/or enlarging boreholes.

The plurality of rotatable cutting structure assemblies 212 may include a plurality of legs 216 and a plurality of rotatable cutting structures 218, each respectively mounted to a leg 216. The plurality of legs 216 may extend from an end of the body 202 opposite the pin 206 and may extend in the axial direction. The plurality of blades 214 may also extend from the end of the body 202 opposite the pin 206 and may extend in both the axial and radial directions. Each blade 214 may have multiple, radially extending profile regions as known in the art (cone, nose, shoulder, and gage). In some embodiments, two or more blades 214 of the plurality of blades 214 may be located between adjacent legs 216 of the plurality of legs 216. In some embodiments, the plurality of rotatable cutting structure assemblies 212 may not include a plurality of legs 216 but may be mounted directed to the crown 210 on the body 202 of the earth-boring tool 200.

Fluid courses 234 may be formed between adjacent blades 214 of the plurality of blades 214 and may be provided with drilling fluid by ports located at the end of passages leading from an internal fluid plenum extending through the body 202 from tubular shank 208 at the upper end of the earth-boring tool 200. Nozzles 238 may be secured within the ports for enhancing direction of fluid flow and controlling flow rate of the drilling fluid. The fluid courses 234 extend to junk slots 240 extending axially along the longitudinal side of earth-boring tool 200 between blades 214 of the plurality of blades 214.

Figure 3:
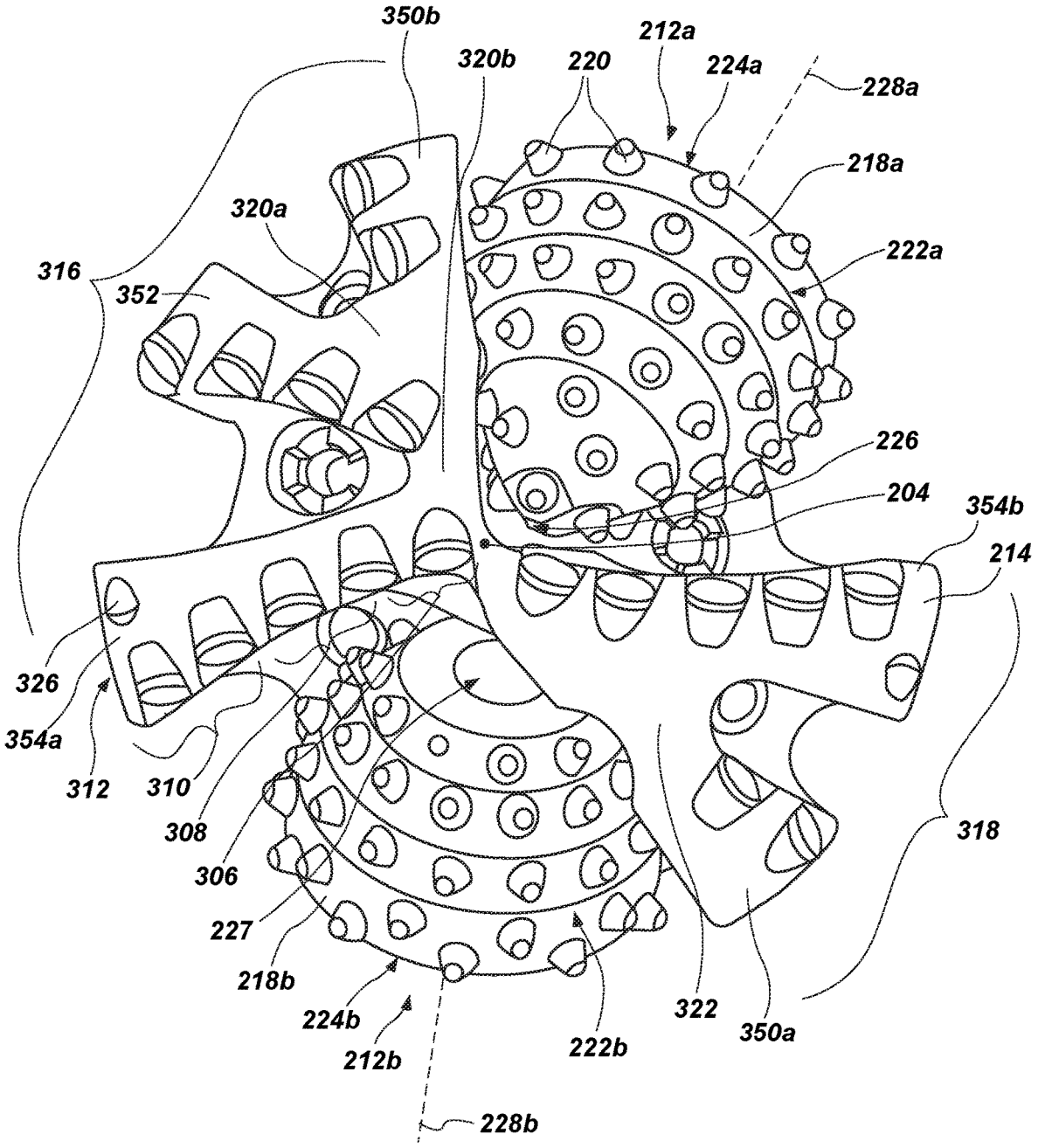
FIG. 3 is a bottom view of an earth-boring tool according to one or more embodiments of the present disclosure.

FIG. 3 is a top view of the earth-boring tool 200 of FIG. 2. As is known in the art, the earth-boring tool 200 (e.g., blades 214 of the earth-boring tool 200) may include a cone region 306, a nose region 308, a shoulder region 310, and a gage region 312. In some embodiments, the plurality of blades 214 may include five blades. In some embodiments, at least two blades 350*a*, 350*b* of the five blades may extend from the gage region 312 of the earth-boring tool 200 to the shoulder region 310 of the earth-boring tool 200. Additionally, cutting profiles (e.g., the plurality of cutting elements 230) of the two blades 350*a*, 350*b* may extend from the gage region 312 of the earth-boring tool 200 to the shoulder region 310 of the earth-boring tool 200. Furthermore, one blade 352 of the five blades may extend from the gage region 312 of the earth-boring tool 200 to a radially inner extent of the nose region 308 of the earth-boring tool 200. A cutting profile of the one blade 352 may extend from the gage region 312 of the earth-boring tool 200 to the nose region 308 of the earth-boring tool 200. Moreover, two additional blades 354*a*, 354*b* of the five blades may extend from the gage region 312 of the earth-boring tool 200 to at least the cone region 306 of the earth-boring tool 200. Furthermore, cutting profiles of the additional blades 354*a*, 354*b* may extend from the gage region 312 of the earth-boring tool 200 to at least the cone region 306 of the earth-boring tool 200. In other words, each blade of the two additional blades 354*a*, 354*b* may include cutting elements 230 disposed throughout the cone region 306, the nose region 308, the shoulder region 310, and the gage region 312 of the earth-boring tool 200. In view of the foregoing, earth-boring tool 200 may include at least two blades extending to the center of the earth-boring tool 200.

In some instances, the five blades may include two sets of connected blades 316, 318. For example, the five blades may include a first set of connected blades 316 (hereinafter "first set of blades") and a second set of connected blades 318 (hereinafter "second set of blades"). In some embodiments, the first set of blades 316 may include at least three blades, and the second set of blades 318 may include at least two blades. Furthermore, in some embodiments, the first and second sets of blades 316, 318 may be disposed on opposite lateral sides of the earth-boring tool 200.

In some embodiments, the first set of blades 316 may be connected together via a first connector portion 320*a* (e.g., a webbing between the set of blades) and a second connector portion 320*b*. In one or more embodiments, the first connector portion 320*a* may connect ends of two of the blades of the first set of blades 316 proximate the nose region 308 of the earth-boring tool 200. In particular, the first connector portion 320*a* may extend between the two blades of the first set of blades 316 such that the two blades form a generally V-shape. In some embodiments, the second connector portion 320*b* may connect the ends of the two blades of the first set of blades 316 with an end of another blade of the first set of blades 316 proximate the cone region 306 of the earth-boring tool 200. For instance, the second connector portion 320*b* may extend between the two blades of the first set of blades 316 and the another blade such that the first set of blades 316 form a generally larger V-shape.

In one or more embodiments, the first set of blades 316 may include a first blade (e.g., blade 354*a*) that extends from the gage region 312 of the earth-boring tool 200 to the center longitudinal axis 205 of the earth-boring tool 200, and a cutting profile of the first blade may extend from the gage region 312 of the earth-boring tool 200 to the of cone region 306 the earth-boring tool 200. Additionally, the first set of blades 316 may include a second blade (e.g., blade 352) that extends from the gage region 312 of the earth-boring tool 200 to the nose region 308 of the earth-boring tool 200, and a cutting profile of the second blade may extend from the gage region 312 of the earth-boring tool 200 to the nose region 308 of the earth-boring tool 200. Moreover, the first set of blades 316 may include a third blade (e.g., blade 350*b*) that extends from the gage region 312 of the earth-boring tool 200 to the shoulder region 310 of the earth-boring tool 200, and a cutting profile of the third blade may extend from the gage region 312 of the earth-boring tool 200 to the shoulder region 310 of the earth-boring tool 200.

The second set of blades 318 may be connected together via a third connector portion 322. In some embodiments, the third connector portion 322 may connect ends of the second set of blades 318 proximate the cone region 306 of the earth-boring tool 200. In particular, the third connector portion 322 may extend between the blades of the second set of blades 318 such that the second set of blades 318 forms a generally V-shape. In some embodiments, the first and second sets of blades 316, 318 may be pointed toward each other laterally across the earth-boring tool 200. For example, points of the V-shapes formed by the first and second sets of blades 316, 318 may generally point toward each other. Moreover, in some embodiments, the first set of blades 316 may be connected to the second set of blades 318 via a fourth connector portion extending across the axial center 204 of the body 202 of the earth-boring tool 200.

In one or more embodiments, the second set of blades 318 may include a fourth blade (e.g., blade 354*b*) that extends from the gage region 312 of the earth-boring tool 200 to the center longitudinal axis 205 of the earth-boring tool 200, and a cutting profile of the fourth blade may extend from the gage region 312 of the earth-boring tool 200 to the cone region 306 of the earth-boring tool 200. Also, the second set of blades 318 may include a fifth blade (e.g., blade 350*a*) that extends from the gage region 312 of the earth-boring tool 200 to the shoulder region 310 of the earth-boring tool 200, and a cutting profile of the fifth blade may extend from the gage region 312 of the earth-boring tool 200 to the shoulder region 310 of the earth-boring tool 200.

Referring to FIGS. 2 and 3 together, in one or more embodiments, the plurality of rotatable cutting structure assemblies 212 may include a first rotatable cutting structure assembly 212*a* and a second rotatable cutting structure assembly 212*b*. Furthermore, the first and second rotatable cutting structure assemblies 212*a*, 212*b* may be disposed angularly between the first and second sets of blades 316, 318 and at least generally on opposite lateral sides of the earth-boring tool 200. In other words, each of the first and second rotatable cutting structure assemblies 212*a*, 212*b* may be disposed between the first and second sets of blades 316, 318 along a rotational direction of the earth-boring tool 200. The first rotatable cutting structure assembly 212*a* may include a first rotatable cutting structure 218*a* rotatably mounted to a first leg 216*a* of the first rotatable cutting structure assembly 212*a*. The second rotatable cutting structure assembly 212*b* may include a second rotatable cutting structure 218*b* rotatably mounted to a second leg 216*b* of the second rotatable cutting structure assembly 212*b*. For example, each of the first and second rotatable cutting structures 218*a*, 218*b* may be mounted to a respective leg 216*a*, 216*b* with one or more of a journal bearing and rolling-element bearing. Many such bearing systems are known in the art and may be employed in embodiments of the present disclosure.

Each of the first and second rotatable cutting structures 218*a*, 218*b* may have a plurality of cutting elements 220 disposed thereon, such cutting elements commonly referred to in the art as "inserts." In some embodiments, the plurality of cutting elements 220 of each of the first and second rotatable cutting structures 218*a*, 218*b* may be arranged in generally circumferential rows on respective outer surfaces 222*a*, 222*b* of the first and second rotatable cutting structures 218*a*, 218*b*. In other embodiments, the cutting elements 220 may be arranged in an at least substantially random configuration on the respective outer surfaces 222*a*, 222*b* of the first and second rotatable cutting structures 218*a*, 218*b*. In some embodiments, the cutting elements 220 may comprise preformed inserts that are interference fitted into apertures formed in each of the first and second rotatable cutting structures 218*a*, 218*b*. In other embodiments, the cutting elements 220 of the first and second rotatable cutting structures 218*a*, 218*b* may be in the form of teeth integrally formed with the material of each of the first and second rotatable cutting structures 218*a*, 218*b*. The cutting elements 220, if in the form of inserts received in apertures in a rotatable cutting structure 218, may be formed from tungsten carbide, and optionally have a distal surface of polycrystalline diamond, cubic boron nitride, or any other wear-resistant and/or abrasive or superabrasive material.

In some embodiments, the first rotatable cutting structure 218*a* may have a general conical shape, with a base end 224*a* (e.g., wide end and radially outermost end 224*a*) of the conical shape being mounted to the first leg 216*a* and a tapered end 226 (e.g., radially innermost end 226) being proximate (e.g., at least substantially pointed toward) the axial center 204 of the body 202 of the earth-boring tool 200. The first rotatable cutting structure 218*a* may define a first cutting profile that extends from the gage region 312 of the earth-boring tool 200 to the cone region 306 of the earth-boring tool 200. In one or more embodiments, the first cutting profile may extend from the gage region 312 of the earth-boring tool 200 to a location proximate axial center 204 of the earth-boring tool 200. Put another way, the first rotatable cutting structure 218*a* may extend to center. In some embodiments, a distance between the axial center 204 and the tapered end 226 of the first rotatable cutting structure 218*a* may be within a range of about 0.0% to about 10.0% of the overall outer diameter of the earth-boring tool 200. In additional embodiments, the distance between the axial center 204 and the tapered end 226 of the first rotatable cutting structure 218*a* may be within a range of about 0.0% to about 5.0% of the overall outer diameter of the earth-boring tool 200. In further embodiments, the distance between the axial center 204 and the tapered end 226 of the first rotatable cutting structure 218*a* may be within a range of about 0.0% to about 2.5% of an overall outer diameter of the earth-boring tool 200. In some embodiments, the distance between the axial center 204 and the tapered end 226 of the first rotatable cutting structure 218*a* may vary while the first rotatable cutting structure 218*a* rotates. For example, at some points of rotation, the distance may be about 10.0% of the overall outer diameter of the earth-boring tool 200 and at other points the distance may be about 2.5% of the overall outer diameter of the earth-boring tool 200.

In one or more embodiments, the second rotatable cutting structure 218*b* may have a general frusto-conical shape (e.g., a truncated conical shape), with a base end 224*b* (e.g., wide end and radially outermost end 224*b*) of the frusto-conical shape being mounted to the second leg 216*b* and a truncated end 227 (e.g., radially innermost end 227) being proximate an innermost boundary of the nose region 308 of the earth-boring tool 200. The second rotatable cutting structure 218*b* may define a second cutting profile that extends from the gage region 312 of the earth-boring tool 200 to a location proximate the innermost boundary of the nose region 308 of the earth-boring tool 200. In other words, the second rotatable cutting structure 218*b* may not extend to center. In other embodiments, each of the first and second rotatable cutting structures 218*a*, 218*b* may not have a general conical shape or frusto-conical shape but may have any shape appropriate for rotatable cutting structures.

By having at least one cutting profile (e.g., the first cutting profile) of the first and second rotatable cutting structures 218*a*, 218*b* extend to a location proximate to or at the axial center 204 of the body 202 of the earth-boring tool 200 (i.e., to center), the earth-boring tool 200 may provide advantages over conventional earth-boring tools. For example, because the earth-boring tool 200 provides a rotatable cutting structure to center, the earth-boring tool 200 may at least partially reduce and/or prevent core-outs that are common with conventional earth-boring tools. As used herein, the term "core-out" may refer to when fixed cutting elements of a drill bit near the axial center 204 of the drill bit (e.g., within the cone region 306) wear out (e.g., are damaged and/or broken off) prior (e.g., significantly prior) to cutting elements farther out from the axial center 204 of the drill bit (e.g., within the nose, shoulder, and gage regions). Drill bits that experience core-outs must be repaired and/or replaced prior to continuing with drilling operations. By reducing and/or prevent core-outs, the earth-boring tool 200 of the present disclosure may enable cutting elements throughout the earth-boring tool 200 to wear at substantially the same rate. As a result, the earth-boring tool 200 may reduce wear per time of each cutting element, may increase life spans of cutting elements and the earth-boring tool 200, may provide more consistent drilling, and may reduce repair and replacement costs.

Each of the first and second rotatable cutting structures 218*a*, 218*b* may have a respective rotational axis 228*a*, 228*b* (e.g., longitudinal axis) about which the first and second rotatable cutting structures 218*a*, 218*b* may rotate during use of the earth-boring tool 200 in a drilling operation. In some embodiments, the rotational axis 228*a*, 228*b* of each of the first and second rotatable cutting structures 218*a*, 218*b* may intersect the axial center 204 of the earth-boring tool 200. In other embodiments, the rotational axis 228*a*, 228*b* of one or more of the first and second rotatable cutting structures 218*a*, 218*b* may be offset from the axial center 204 of the earth-boring tool 200. For example, the rotational axis 228*a*, 228*b* of one or more of the first and second rotatable cutting structures 218*a*, 218*b* may be laterally offset (e.g., angularly skewed) such that the rotational axis 228*a*, 228*b* of the one of more of the first and second rotatable cutting structures 218*a*, 218*b* does not intersect the axial center 204 of the earth-boring tool 200. In some embodiments, the radially innermost end 227 (i.e., the truncated end 227) of the second rotatable cutting structure 218*b* may be radially spaced from the axial center 204 of the earth-boring tool 200.

In some embodiments, the first and second rotatable cutting structures 218*a*, 218*b* may be angularly spaced apart from each other around the center longitudinal axis 205 of the earth-boring tool 200. For example, the first rotational axis 228*a* of the first rotatable cutting structure 218*a* may be circumferentially angularly spaced apart from the second rotational axis 228*b* of the second rotatable cutting structure 218*b* by about 75° to about 180°. In some embodiments, the first and second rotatable cutting structures 218*a*, 218*b* may be angularly spaced apart from one another by an acute angle. For example, in some embodiments, the first and second rotatable cutting structures 218*a*, 218*b* may be angularly spaced apart from one another by about 120°. In other embodiments, the first and second rotatable cutting structures 218*a*, 218*b* may be angularly spaced apart from one another by about 160°. In other embodiments, the first and second rotatable cutting structures 218*a*, 218*b* may be angularly spaced apart from one another by about 180°. Although specific degrees of separation of rotational axes (i.e., number of degrees) are disclosed herein, one of ordinary skill in the art would recognize that the first and second rotatable cutting structures 218*a*, 218*b* may be angularly spaced apart from one another by any suitable amount.

Referring still to FIGS. 2 and 3, at least one blade of the five blades may include inserts 326 (e.g., tungsten carbide inserts) disposed proximate the gage region 312 of the earth-boring tool 200. The inserts 326 may trail cutting elements 230 of a respective blade 214 in a direction of rotation of the earth-boring tool 200. In some embodiments, the inserts may include inserts such as the inserts described in U.S. Pat. No. 9,316,058 to Bilen, issued Apr. 19, 2016, the disclosure of which is incorporated in its entirety by reference herein. In one or more embodiments, the inserts 326 of each blade of the first set of five blades may be configured to engage simultaneously at a depth of cut ("DOC") within a range of about 0.150 inch to about 0.175 inch. For example, the inserts 326 of each blade of the first set of five blades may be configured to engage simultaneously at a DOC of about 0.166 inch. Furthermore, the inserts 326 may be offset from the gage region 312 of the earth-boring tool 200 by about 0.60 inch. In some instances, the inserts 326 may improve a durability of shoulder regions 310 of the blades 214.

In some embodiments, a leading edge of a leading blade of the first set of blades 316 and a trailing edge of a trailing blade of the second set of blades 318 may define a chordal extending angularly for an angle within the range of about 180° and about 220°. For example, the leading edge of the leading blade of the first set of blades 316 and the trailing edge of the trailing blade of the second set of blades 318 may define a chordal extending angularly for an angle about 200°. The chordal may provide stability for the earth-boring tool 200. For example, the chordal may at least partially prevent the earth-boring tool 200 from becoming off-center.

Figure 4:
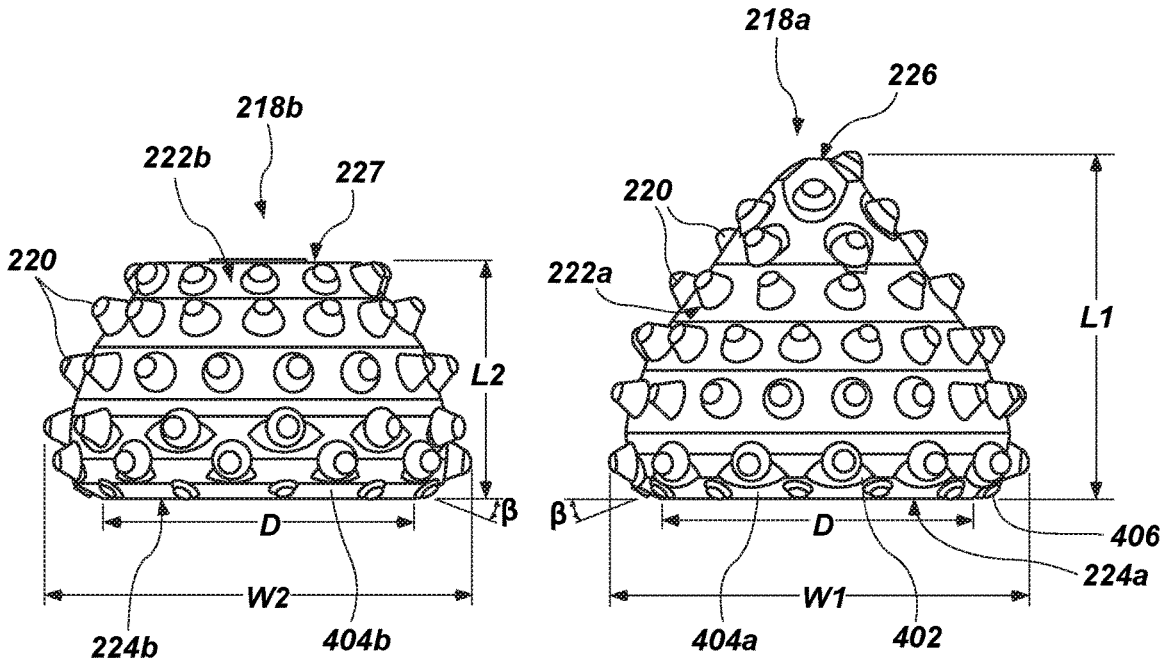
FIG. 4 is a side view of rotatable cutting structures of an earth-boring tool according to one or more embodiments of the present disclosure.

FIG. 4 is a side view of the first rotatable cutting structure 218*a* of the earth-boring tool 200 and the second rotatable cutting structure 218*b* of the earth-boring tool 200 according to one or more embodiments of the present disclosure. As mentioned above, the both the first and second rotatable cutting structures 218*a*, 218*b* may have a plurality of cutting elements 220 disposed thereon. Furthermore, the plurality of cutting elements 220 of each of the first and second rotatable cutting structures 218*a*, 218*b* may be arranged in generally circumferential rows on respective outer surfaces 222*a*, 222*b* of the first and second rotatable cutting structures 218*a*, 218*b*.

Moreover, as noted above, the first rotatable cutting structure 218*a* may have a general conical shape having the base end 224*a* (radially outermost end 224*a* when mounted to the earth-boring tool 200) and the opposite tapered end 226 (e.g., radially innermost end 226 when mounted to the earth-boring tool 200). Furthermore, the second rotatable cutting structure 218*b* may have a general truncated conical shape having the base end 224*b* (radially outermost end 224*b* when mounted to the earth-boring tool 200) and the opposite truncated end 227 (e.g., radially innermost end 227 when mounted to the earth-boring tool 200).

In some embodiments, the plurality of cutting elements 220 may project from the first and second rotatable cutting structures 218*a*, 218*b* a distance within a range of about 0.225 inch and about 0.300 inch. For example, in some instances, one or more of the plurality of cutting elements 220 may project a distance of about 0.259 inch, and one or more of the plurality of cutting elements 220 may project a distance of about 0.282 inch. As a non-limiting example, cutting elements 220 near the base ends 224*a*, 224*b* of the first and second rotatable cutting structures 218*a* 218*b* may project a distance of about 0.259 inch, and other cutting elements 220 of the first and second rotatable cutting structures 218*a* 218*b* may project a distance of about 0.282 inch.

Furthermore, in one or more embodiments, the plurality of cutting elements 220 may have nose radiuses within a range of about 0.100 inch and about 0.200 inch. For example, the cutting elements 220 near the base ends 224*a*, 224*b* of the first and second rotatable cutting structures 218*a* 218*b* may have nose radiuses of about 0.156 inch. Additionally, the other cutting elements 220 of the first and second rotatable cutting structures 218*a* 218*b* may have nose radiuses of about 0.125 inch.

In some embodiments, one or more rows of cutting elements 220 of the first rotatable cutting structure 218*a* may be recessed relative to other rows of cutting elements 220. For example, each cutting element 220 of a respective row of cutting elements 220 may be disposed in a recess 402. In some instances, a row of cutting elements 220 most proximate the base or "heel" end 224*a* of the first rotatable cutting structure 218*a* may be recessed relative to other rows of cutting elements 220. Additionally, the second rotatable cutting structure 218*b* may also include one or more recessed rows of cutting elements 220. Furthermore, in some instances, each cutting element 220 of the plurality of cutting elements 220 of both of the first and second rotatable cutting structures 218*a*, 218*b* may have a generally conical shape. For example, the plurality of cutting elements 220 of both of the first and second rotatable cutting structures 218*a*, 218*b* may not include wedge shapes.

In some instances, a row of cutting elements 220 most proximate the base end 224*a* of the first rotatable cutting structure 218*a* may include between 12 and 14 cutting elements (e.g., 13 cutting elements). Additionally, a row of cutting elements 220 most proximate the base end 224*b* of the second rotatable cutting structure 218*b* may include between 10 and 12 cutting elements (e.g., 11 cutting elements).

In one or more embodiments, the base end 224*a*, 224*b* of both of the first and second rotatable cutting structures 218*a*, 218*b* may include a respective frusto-conical surface 404*a*, 404*b*. Furthermore, both of the first and second rotatable cutting structures 218*a*, 218*b* may include a plurality of impact inserts 406 disposed on their respective frusto-conical surfaces 404*a*, 404*b* (e.g., inserted into a portion of the first or second rotatable cutting structures 218*a*, 218*b* defining the frusto-conical surface 404*a*, 404*b*).

Furthermore the first rotatable cutting structure 218*a* may have a greater longitudinal length than the second rotatable cutting structure 218*b* along the rotational axes 228*a*, 228*b* of the first and second rotatable cutting structures 218*a*, 218*b*. For example, in some embodiments, the first rotatable cutting structure 218*a* may have a first longitudinal length L1 within a range of about 3.2 inches and about 3.7 inches, and the second rotatable cutting structure 218*b* may have a second longitudinal length L2 within a range of about 2.3 inches and about 2.7 inches. For instance, the first rotatable cutting structure 218*a* may have a first longitudinal length L1 of about 3.5 inches, and the second rotatable cutting structure 218*b* may have a second longitudinal length L2 of about 2.5 inches. In some instances, a ratio of the first longitudinal length L1 to the second longitudinal length may be within a range of about 1.2 to about 1.6. For example, the ratio of the first longitudinal length L1 to the second longitudinal length may be about 1.4. The greater first longitudinal length L1 of the first rotatable cutting structure 218*a* may enable the first rotatable cutting structure 218*a* to extend to a location proximate to the axial center 204 of the earth-boring tool 200 (e.g., may allow the first rotatable cutting structure 218*a* to extend to center).

Furthermore, in some embodiments, a ratio of the first longitudinal length L1 and an outer diameter of the earth-boring tool 200 may be within a range of about 0.40 and about 0.50. For example, the ratio of the first longitudinal length L1 and the outer diameter of the earth-boring tool 200 may be about 0.41. Moreover, in some embodiments, a ratio of the second longitudinal length L2 and the outer diameter of the earth-boring tool 200 may be within a range of about 0.25 and about 0.35. For example, the ratio of the second longitudinal length L2 and the outer diameter of the earth-boring tool 200 may be about 0.30.

Furthermore, both of the first and second rotatable cutting structures 218*a*, 218*b* may have a width within a range of about 4.0 inches to about 5.0 inches. For example, the first rotatable cutting structure 218*a* may have a width W1 of about 4.4 inches, and the second rotatable cutting structure 218*b* may have a width W2 of about 4.5 inches. Moreover, the frusto-conical surface 404*a*, 404*b* of a respective rotatable cutting structure of the first and second rotatable cutting structures 218*a*, 218*b* may define an angle β with a plane orthogonal to the rotational axis of a respective rotatable cutting structure. In some embodiments, the angle β may be within a range of about 25° and about 35°. For example, the angle β may be about 31°. Additionally, the base ends 224*a*, 224*b* of both of the first and second rotatable cutting structures 218*a*, 218*b* may have a diameter D within a range of about 2.8 inches and about 3.6 inches. For instance, the base ends 224*a*, 224*b* may have a diameter of about 3.2 inches. In some embodiments, both the first and second rotatable cutting structures 218*a*, 218*b* may be coupled to a respective leg 216 (FIG. 2) of the earth-boring tool 200 via an inch bearing (e.g., a journal bearing and/or rolling element bearing) having a size within a range of 2.25 inches and about 3.25 inches.

In one or more embodiments, the first rotatable cutting structure 218*a* may be about 5% to about 10% larger than the second rotatable cutting structure 218*b* by volume. In additional embodiments, the first rotatable cutting structure 218*a* may be about 7% to about 9% larger than the second rotatable cutting structure 218*b* by volume. For example, the first rotatable cutting structure 218*a* may be about 8% larger than the second rotatable cutting structure 218*b* by volume.

In view of the foregoing, the first and second rotatable cutting structures 218*a*, 218*b* of the present disclosure may provide advantages over conventional rotatable cutting structures. For example, the rotatable cutting structures of the present disclosure may exhibit a roll ratio within a range of about 1.55 and about 1.70 when used in an earth-boring tool (e.g., earth-boring tool 200). For instance, the rotatable cutting structures of the present disclosure may exhibit a roll ratio of about 1.63. As used herein, the term "roll ratio" may refer to a number of times a rotatable cutting structure rotates relative to a full rotation of an earth-boring tool upon which the rotatable cutting structure is being used. Reducing the roll ratio may reduce wear on the cutting elements 220 of the rotatable cutting structure and may increase a life span of the cutting elements 220 and, as a result, the rotatable cutting structure.

Referring to FIGS. 3 and 4 together, in a drilling operation, as will be understood by one of ordinary skill in the art, the first and second rotatable cutting structures 218*a*, 218*b* may remove material (e.g., break up material) from a formation in order to drill and/or enlarge boreholes. In some embodiments, of a total volume of removed material by the first and second rotatable cutting structures 218*a*, 218*b*, the first rotatable cutting structure 218*a* may remove between about 55% and 65% of the material and the second rotatable cutting structure 218*b* may remove between about 35% and 45% of the material. As a non-limiting example, the first rotatable cutting structure 218*a* may remove about 60% of the material and the second rotatable cutting structure 218*b* may remove about 40% of the material.

Furthermore, during operation, the first and second rotatable cutting structures 218*a*, 218*b* may exhibit increased removal rates at relatively low depths of cut (DOC). For example, on one hand, at a DOC of about 0.050 inch, the first and second rotatable cutting structures 218*a*, 218*b* may remove about 8.5% of a total volume of material removed by the earth-boring tool 200. On the other hand, at a DOC of about 0.007 inch, the first and second rotatable cutting structures 218*a*, 218*b* may remove about 29.5% of a total volume of material removed by the earth-boring tool 200. Thus, at relatively low depths of cut, the earth-boring tool 200 of the present disclosure may provide advantages over conventional earth-boring tools. For example, by removing a higher percentage of a total volume of material removed by the earth-boring tool 200, the earth-boring tool 200 of the present disclosure may reduce wear on the blades 214 and the cutting elements 230 of the blades 214 of the earth-boring tool 200. Accordingly, the earth-boring tool 200 of the present disclosure may increase lifespans of the cutting elements 230 and blades 214 and, as a result, the earth-boring tool 200. Thus, the earth-boring tool 200 of the present disclosure may require less maintenance and may lead to cost savings.

Figure 5:
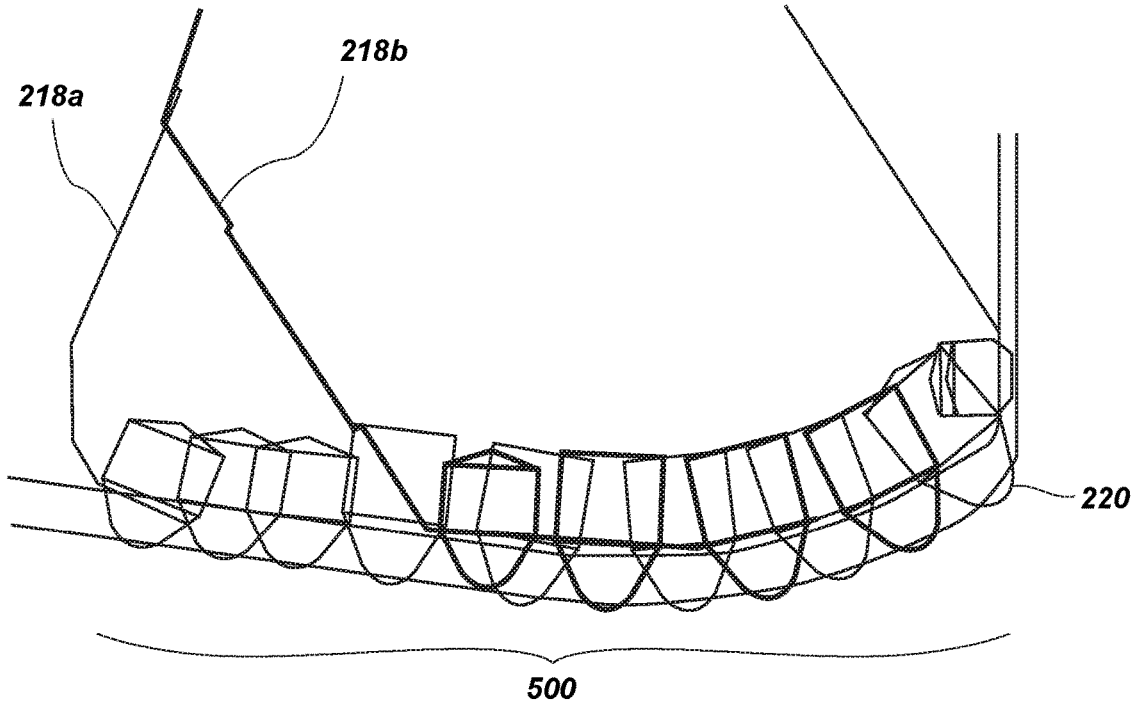
FIG. 5 is partial-schematic-cross-sectional view of a cutting profile of a rotatable cutting structure according to an embodiment of the present disclosure.

FIG. 5 shows a schematic view of a cutting profile 500 defined by the first and second rotatable cutting structures 218*a*, 218*b* of an earth-boring tool (e.g., earth-boring tool 200) according to one or more embodiments of the present disclosure. In some embodiments, within a radius of about 1 inch from the center longitudinal axis 205 (FIG. 2) of the earth-boring tool 200 (FIG. 2), the cutting profile 500 may include two cutting elements 220. Within a radius of about 1 inch to about 2 inches from the center longitudinal axis 205 (FIG. 2), the cutting profile 500 may include two cutting elements 220. Within a radius of about 2 inches to about 3 inches from the center longitudinal axis 205 (FIG. 2), the cutting profile 500 may include four cutting elements 220. Within a radius of about 3 inches to about 4 inches from the center longitudinal axis 205 (FIG. 2), the cutting profile 500 may include four cutting elements 230.

Figure 6:
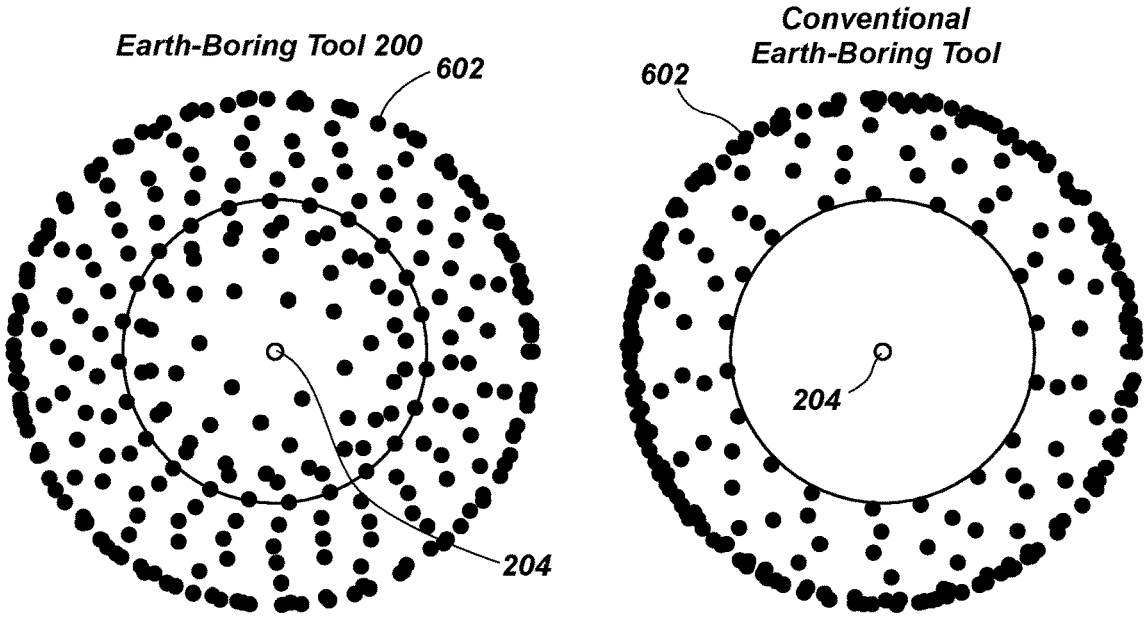
FIG. 6 is a schematic representation of contact locations of cutting elements of a rotatable cutting structure of an earth-boring tool with a formation throughout a rotation of the earth-boring tool.

FIG. 6 shows a schematic representation of contact locations 602 where cutting elements 220 (FIGS. 2 and 3) of the first and second rotatable cutting structures 218*a*, 218*b* (FIGS. 2 and 3) may contact a formation 118 (FIG. 1) during a single rotation of the earth-boring tool 200 (FIG. 3) in comparison to a schematic representation of contact locations 602 where cutting elements of rotatable cutting structures of a conventional hybrid earth-boring tool contact a formation 118 (FIG. 1) during a single rotation of the earth-boring tool. As shown in FIG. 6, the earth-boring tool 200 (FIG. 3) of the present disclosure may provide a higher density of contact locations 602 outside of a 4.5 inch diameter centered about the axial center 204 (FIG. 3) of the earth-boring tool 200 in comparison to the conventional hybrid earth-boring tool. Furthermore, the earth-boring tool 200 (FIG. 3) of the present disclosure may provide contact locations 602 within the 4.5 inch diameter where in the conventional hybrid earth-boring tool provides no contact locations 602. As will be understood by one of ordinary skill in the art, by providing an overall higher density of contact locations 602 and contact locations 602 within the 4.5 inch diameter, the earth-boring tool 200 may provide improved drilling capabilities in comparison to conventional hybrid earth-boring tools. For example, the earth-boring tool 200 (FIG. 3) may remove more material than the conventional earth-boring tool. Furthermore, the earth-boring tool 200 (FIG. 3) may reduce a workload on cutting elements 230 (FIG. 3) of the blades 214 (FIG. 3), which, as is discussed above, may reduce wear on the cutting elements 230 (FIG. 3) of the blades 214 (FIG. 3) and may increase a lifespan of the earth-boring tool 200 (FIG. 3).

Figure 7:
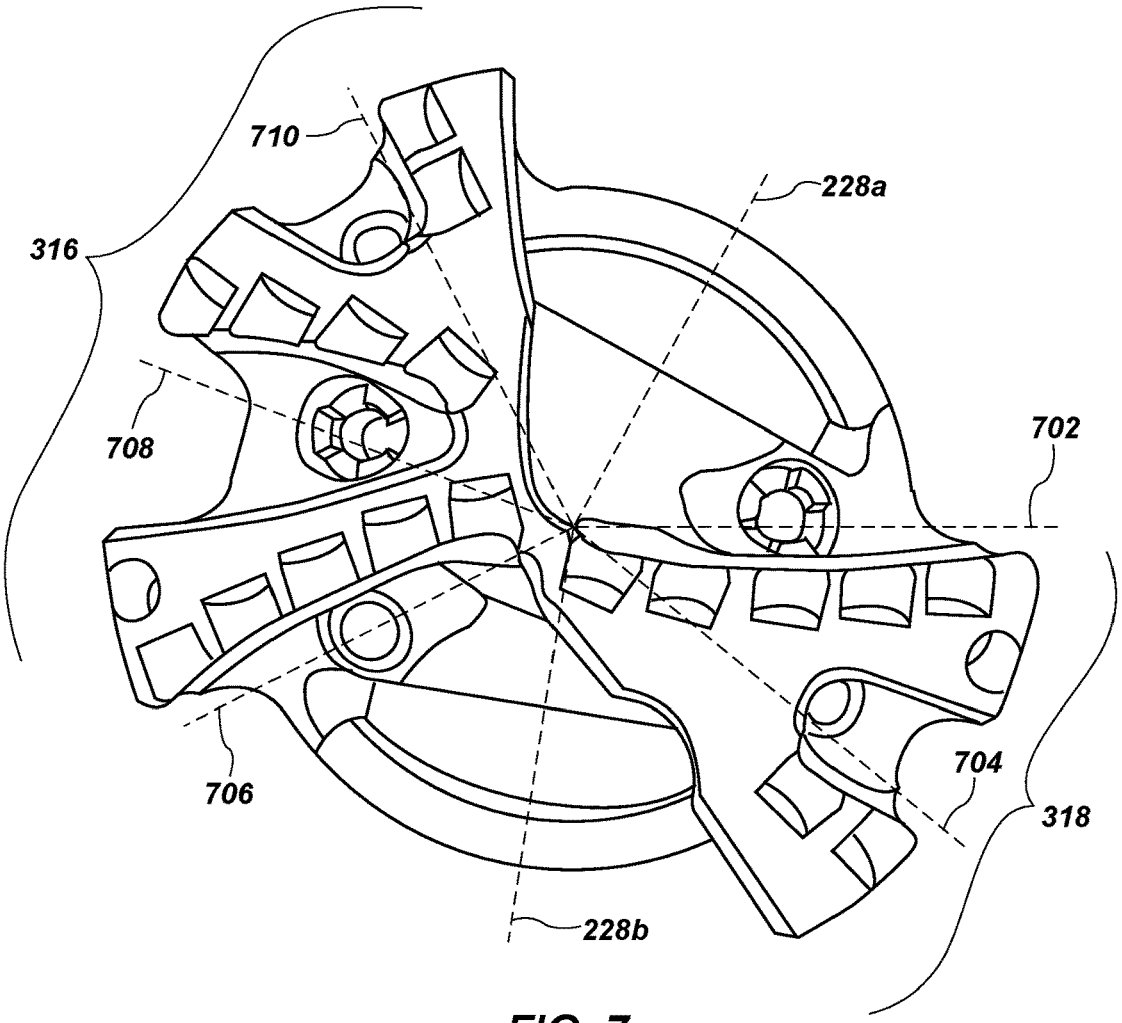
FIG. 7 is a bottom perspective view of an earth-boring tool according to one or more embodiments of the present disclosure.

FIG. 7 is a bottom view of a bit body and blades of an earth-boring tool 200 according to one or more embodiments of the present disclosure. The cutting elements 230 of the blades and the first and second rotatable cutting structures 218*a*, 218*b* of the earth-boring tool 200 are removed to better show structure of the body 202 and positioning of the blades 214 of an earth-boring tool 200. For purposes of the present disclosure, the blades of the earth-boring tool 200 depicted in FIG. 7 will be numbered and described with references to those numbers in order to facilitate description of certain aspects of the earth-boring tool 200. For example, the earth-boring tool 200 may include five numbered blades.

With reference to FIG. 7, blade No. 1 may include a blade of the second set of blades 318 and, as depicted in FIG. 7, may be oriented in a generally 3 o'clock position. Moving clockwise around the earth-boring tool 200, blade No. 2 may include a next rotationally adjacent blade (e.g., a second blade of the second set of blades 318) to blade No. 1. Additionally, blade No. 3 may include a next rotationally adjacent blade (e.g., a first blade of the first set of blades 316) in the clockwise direction. Moreover, blade No. 4 may include a next rotationally adjacent blade (e.g., a second blade of the first set of blades 316) in the clockwise direction. Likewise, blade No. 5 may include a next rotationally adjacent blade in the clockwise direction and another blade of the second set of connected blades 318.

In some embodiments, each blade of the five blades may be spaced apart from each other angularly around the center longitudinal axis 205 of the earth-boring tool 200 by certain angles. For example, a plane 702 extending radially outward from the center longitudinal axis 205 and intersecting a leading face of blade No. 1 (referred to hereinafter as "leading plane") may be circumferentially angularly spaced apart from a leading plane 704 of blade No. 2 by about 35° to about 40°. For instance, in some embodiments, blade No. 1 and blade No. 2 may be angularly spaced apart from one another by about 39°. Additionally, the leading plane 704 of blade No. 2 may be circumferentially angularly spaced apart from the first rotational axis 228*a* of the first rotatable cutting structure 218*a* (FIG. 3) by about 50° to about 70°. For example, leading plane 704 of blade No. 2 and the first rotational axis 228*a* of the first rotatable cutting structure 218*a* (FIG. 3) may be angularly spaced apart from one another by about 60°. Also, the first rotational axis 228*a* of the first rotatable cutting structure 218*a* (FIG. 3) may be circumferentially angularly spaced apart from a leading plane 706 of blade No. 3 by about 40° to about 60°. In particular, in some embodiments, the first rotational axis 228*a* of the first rotatable cutting structure 218*a* (FIG. 3) and the leading plane 706 of blade No. 3 may be angularly spaced apart from one another by about 54°. Moreover, the leading plane 706 of blade No. 3 may be circumferentially angularly spaced apart from a leading plane 708 of blade No. 4 by about 40° to about 60°. For instance, in some embodiments, the leading plane 706 of blade No. 3 and the leading plane 708 of blade No. 4 may be angularly spaced apart from one another by about 48°. Furthermore, the leading plane 708 of blade No. 4 may be circumferentially angularly spaced apart from a leading plane 710 of blade No. 5 by about 35° to about 50°. For example, in some embodiments leading plane 708 of blade No. 4 and the leading plane 710 of blade No. 5 may be angularly spaced apart from one another by about 42°. Likewise, the leading plane 710 of blade No. 5 may be circumferentially angularly spaced apart from the second rotational axis 228*b* of the second rotatable cutting structure 218*b* (FIG. 3) by about 40° to about 60°. For instance, in some embodiments, the leading plane 710 of blade No. 5 and the second rotational axis 228*b* of the second rotatable cutting structure 218*b* (FIG. 3) may be angularly spaced apart from one another by about 56°. Although specific degrees of separation of leading planes (i.e., number of degrees) are disclosed herein, one of ordinary skill in the art would recognize that blades No. 1-5 and the first and second rotatable cutting structures 218*a*, 218*b* (FIG. 3) may be angularly spaced apart from one another by any suitable amount.

Figure 8:
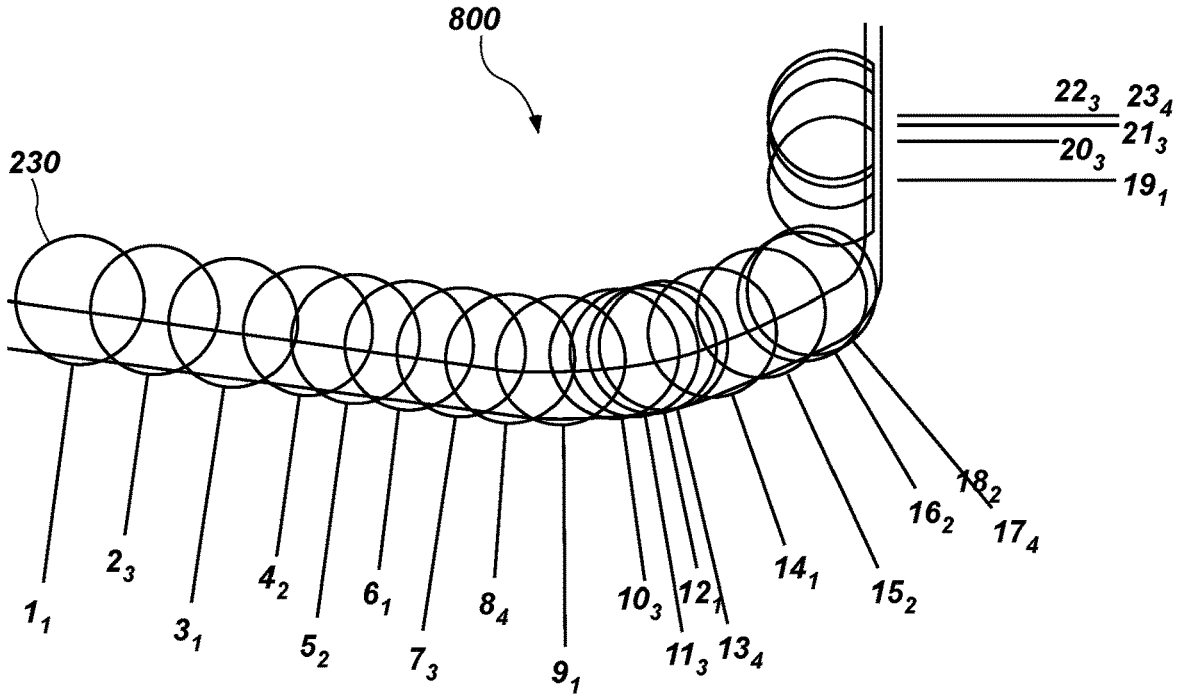
FIG. 8 is a schematic-cross-sectional view of a cutting profile of a blade of an earth-boring tool according to an embodiment of the present disclosure.

FIG. 8 is a schematic representation of a cutting profile 800 that may be defined by cutting elements 230 (FIG. 3) of the blades 214 (FIG. 3) of an earth-boring tool 200 (FIG. 3) when in operation. Referring to FIGS. 3 and 8 together, in comparison to conventional earth-boring tools, a cutter density may be increased in the shoulder and gage regions 310, 312 of the earth-boring tool 200. In some embodiments, within a radius of about 1 inch from the center longitudinal axis 205 of the earth-boring tool 200, the cutting profile 800 may include two cutting elements 230. Within a radius of about 1 inch to about 2 inches from the center longitudinal axis 205, the cutting profile 800 may include four cutting elements 230. Within a radius of about 2 inches to about 3 inches from the center longitudinal axis 205, the cutting profile 800 may include four cutting elements 230. Within a radius of about 3 inches to about 4 inches from the center longitudinal axis 205, the cutting profile 800 may include eight cutting elements 230.

Figure 9:
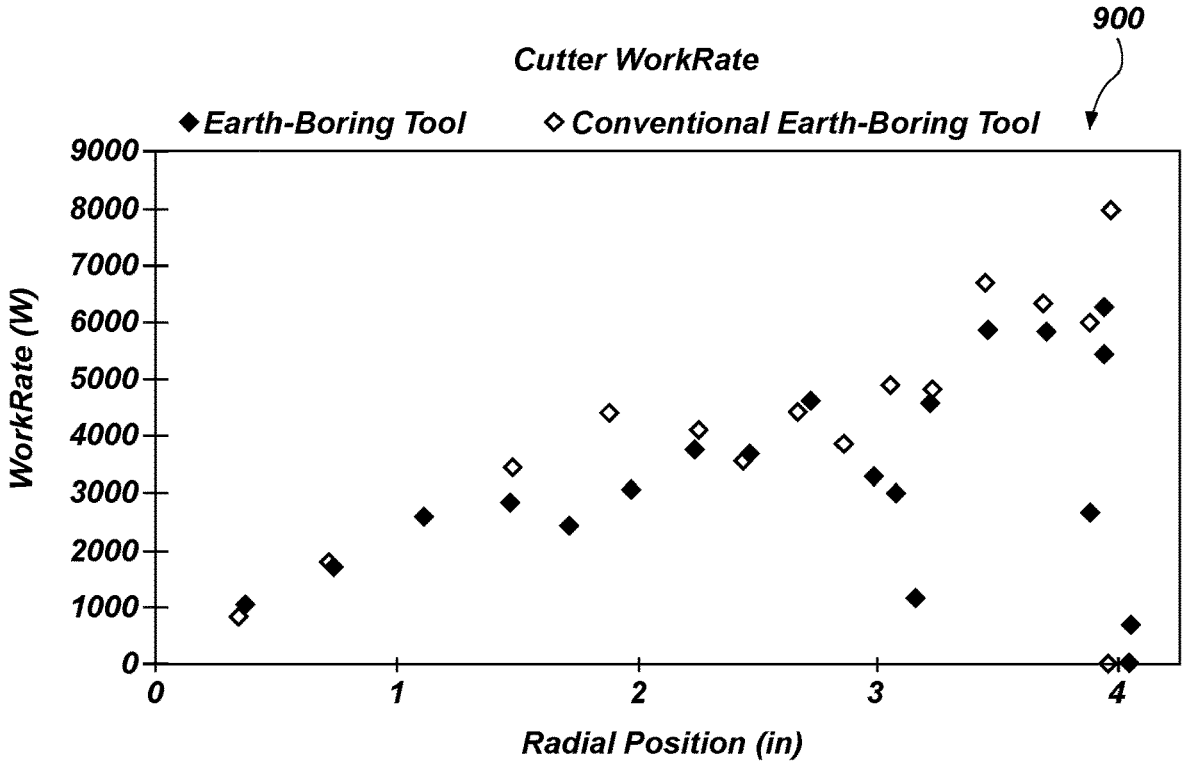
FIG. 9 is a graph showing workrates of cutting elements of an earth-boring tool according to one or more embodiments of the present disclosure.

FIG. 9 is a graph 900 showing workrates (W) of cutting elements of an earth-boring tool (e.g., earth-boring tool 200) of the present disclosure in comparison to workrates of cutting elements of conventional earth-boring tools. As shown in the graph 900, cutting elements located nearer the center longitudinal axis of the earth-boring tool (i.e., located in the respective cone and nose regions of a blade) may be subjected to a lesser work rate than in other regions of the blade. Furthermore, several cutting elements located farther from the longitudinal axis of the earth-boring tool (i.e., located in the shoulder or gage region of the blade) may be subjected to a lower work rates than cutting elements in other regions of the blade and when compared to cutting elements of conventional blades. Such lower work rates may be due to the first rotatable cutting structure extending to and to multiple blades of the plurality of blades 214 extending to each of the cone region (e.g., center), the nose region, and shoulder region of the earth-boring tool.

Furthermore, as shown in graph 900, the earth-boring tool (e.g., earth-boring tool 200 (FIG. 2)) of the present disclosure may not exhibit any increasing spikes or significant upward deviations from a general upward trend of workrates of the cutting elements. Conversely, conventional earth-boring tools typically exhibit cutting elements that are subjected to significantly higher workrates (e.g., spikes in workrates) in comparison to surrounding cutting elements. By avoiding such spikes and/or significant deviations in workrates, the earth-boring tool of the present disclosure can reduce wear on cutting elements, and as such, can increase lifespans of cutting elements. Accordingly, the earth-boring tool of the present disclosure may lead to cost savings and a more durable earth-boring tool.

Figure 10:
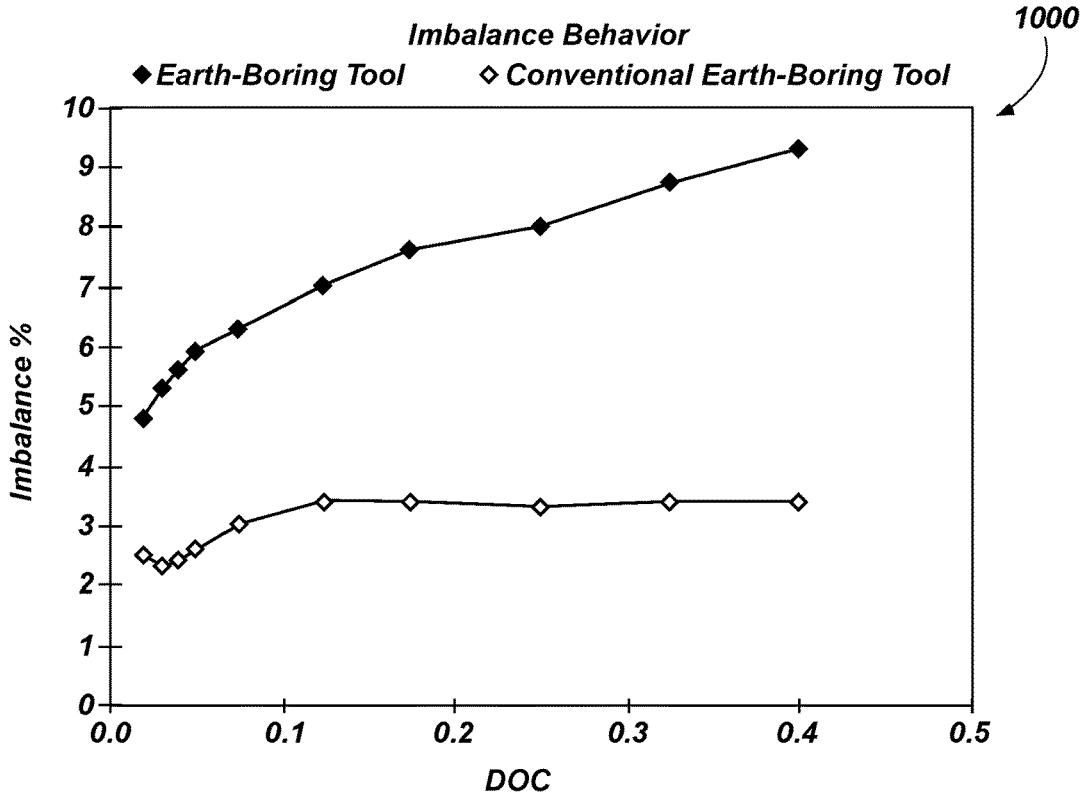
FIG. 10 is a graph showing imbalance percentages of an earth-boring tool according to one or more embodiments of the present disclosure.

FIG. 10 is a graph 1000 showing imbalance percentages of an earth-boring tool (e.g., earth-boring tool 200 (FIG. 2)) of the present disclosure in comparison to imbalance percentages of conventional earth-boring tools. For example, the imbalance percentages may refer to imbalanced forces experienced by an earth-boring tool while in operation resulting from non-symmetric distribution of drilling forces. As shown in FIG. 10, when in operation, the earth-boring tool of the present disclosure may experience imbalance percentages within a range of about 2.5% and about 3.5% while conventional earth-boring tools experience imbalance percentages within a range of about 4.8% to about 9.5%.

By reducing imbalance percentages, the earth-boring tool of the present disclosure may provide more reliable drilling. Furthermore, reducing imbalance percentages may result in increased lifespans of earth-boring tools. Moreover, reducing imbalance percentages may reduce imbalanced wear on the earth-boring tools and cutting elements.

Figure 11:
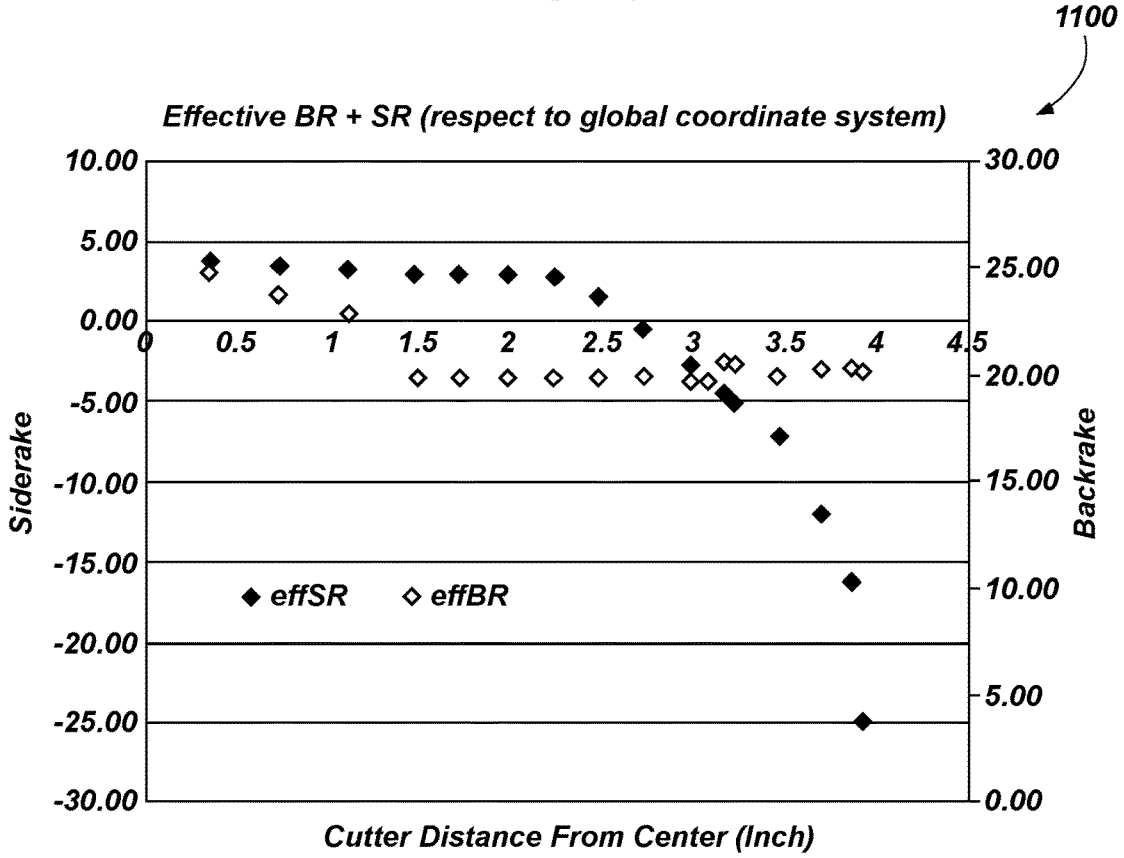
FIG. 11 is a graph showing back rakes and side rakes of cutting elements of an earth-boring tool according to one or more embodiments of the present disclosure.

FIG. 11 is a graph 1100 showing the effective back rakes and side rakes of cutting elements of the blades of the earth-boring tool according to one or more embodiments of the present disclosure. For example, as shown in graph 1100, in some embodiments, the back rake of the cutting elements of the earth-boring tool may be at least substantially uniform outside a cone region of the earth-boring tool 200 (FIG. 2). Furthermore, the side rake of the cutting elements may gradually decrease upon reaching a shoulder and gage region of the earth-boring tool. In some embodiments, the side rake and back rake of the cutting elements may be optimized to increase and integrity and durability of the earth-boring tool.

Referring to FIGS. 2 and 3 again, although the earth-boring tool 200 is shown with five blades and two rotatable cutting structures, the disclosure is not so limited. Rather, the earth-boring tool 200 may include fewer or more blades, and the earth-boring tool 200 may include fewer or more rotatable cutting structures.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. An earth-boring tool, comprising:

a body;

a plurality of blades protruding from the body, each blade extending from a gage region of the earth-boring tool to at least a nose region of the earth-boring tool;

a first rotatable cutting structure assembly coupled to the body and comprising:

a first leg extending from the body of the earth-boring tool; and a first rotatable cutting structure rotatably coupled to the first leg, wherein a first cutting profile of the first rotatable cutting structure extends from the gage region of the earth-boring tool and at least partially through a cone region of the earth-boring tool;

a second rotatable cutting structure assembly coupled to the body and comprising:

a second leg extending from the body of the earth-boring tool; and a second rotatable cutting structure rotatably coupled to the second leg, wherein a second cutting profile of the second rotatable cutting structure extends from the gage region of the earth-boring tool and only to a location proximate an innermost boundary of the nose region of the earth-boring tool.

2. The earth-boring tool of claim 1, wherein the plurality of blades comprises five blades.

3. The earth-boring tool of claim 2, wherein three blades of the five blades are disposed between the first rotatable cutting structure assembly and the second rotatable cutting structure assembly on a first lateral side of the body of the earth-boring tool, and wherein two blades of the five blades are disposed between the first and second rotatable cutting structure assemblies on an opposite, second lateral side of the body of the earth-boring tool.

4. The earth-boring tool of claim 1, wherein a first rotational axis of the first rotatable cutting structure of the first rotatable cutting structure assembly defines an acute angle with a second rotational axis of the second rotatable cutting structure of the second rotatable cutting structure assembly.

5. The earth-boring tool of claim 1, wherein the plurality of blades comprises:

a first set of blades that are connected together via first and second connector portions; and a second set of blades that are connected together via a third connector portion.

6. The earth-boring tool of claim 5, wherein the first set of blades is connected to the second set of blades via a fourth connector portion extending across an axial center of the body of the earth-boring tool.

7. The earth-boring tool of claim 1, wherein at least two blades of the plurality of blades extend from the gage region of the earth-boring tool to an axial center of the body.

8. The earth-boring tool of claim 1, further comprising a plurality of cutting elements secured within each blade of the earth-boring tool.

9. The earth-boring tool of claim 1, wherein the first rotatable cutting structure of the first rotatable cutting structure assembly comprises a generally conical shape, and wherein the second rotatable cutting structure of the second rotatable cutting structure assembly comprises a general frusto-conical shape.

10. The earth-boring tool of claim 9, wherein each rotatable cutting structure of each of the first rotatable cutting structure assembly and the second rotatable cutting structure assembly exhibits a roll ratio relative to each rotation of the earth-boring tool of 1.63.

11. An earth-boring tool, comprising:

a body;

a plurality of blades protruding from the body, each blade extending from a gage region of the earth-boring tool to at least a nose region of the earth-boring tool;

a first rotatable cutting structure assembly coupled to the body and comprising:

a first leg; and a first rotatable cutting structure rotatably coupled to the first leg, wherein the first rotatable cutting structure has a first longitudinal length, and wherein a first cutting profile of the first rotatable cutting structure extends from the gage region of the earth-boring tool and at least partially through a cone region of the earth-boring tool;

a second rotatable cutting structure assembly coupled to the body and comprising:

a second leg; and a second rotatable cutting structure rotatably coupled to the second leg, wherein the second rotatable cutting structure has a second longitudinal length, and wherein a ratio of the first longitudinal length of the first rotatable cutting structure and the second longitudinal length is within a range of 1.2 and 1.6.

12. The earth-boring tool of claim 11, wherein the first rotatable cutting structure is 5% tot 10% larger than the second rotatable cutting structure by volume.

13. The earth-boring tool of claim 11, wherein a first distance to a radially innermost cutting element of the first rotatable cutting structure is less than a second distance to a radially third innermost cutting element of the plurality of blades.

14. The earth-boring tool of claim 11, wherein the plurality of blades comprises:

a first set of blades that are connected together via first and second connector portions; and a second set of blades that are connected together via a third connector portion.

15. The earth-boring tool of claim 14, wherein a leading edge of a leading blade of the first set of blades and a trailing edge of a trailing blade of the second set of blades define a chordal extending angularly for an angle within a range of 180° and 220°.

16. The earth-boring tool of claim 11, further comprising inserts secured to gage regions of at least one blade of the plurality of blades of the earth-boring tool and trailing a plurality of cutting elements of the at least one blade in a direction of rotation of the earth-boring tool.

17. The earth-boring tool of claim 11, further comprising one or more junk slots defined between adjacent blades of the plurality of blades.

18. The earth-boring tool of claim 11, wherein a first cutting profile of the first rotatable cutting structure extends from the gage region of the earth-boring tool and at least partially through the cone region of the earth-boring tool, and wherein a second cutting profile of the second rotatable cutting structure extends from the gage region of the earth-boring tool and only to a nose region of the earth-boring tool.

19. A method of forming an earth-boring tool, comprising:

forming a body of the earth-boring tool comprising a plurality of blades;

coupling a first rotatable cutting structure to a first leg of a first rotatable cutting structure assembly of the earth-boring tool, the first rotatable cutting structure having a first longitudinal length, and wherein a first cutting profile of the first rotatable cutting structure extends from a gage region of the earth-boring tool and at least partially through a cone region of the earth-boring tool; and coupling a second rotatable cutting structure to a second leg of a second rotatable cutting structure assembly of the earth-boring tool, the second rotatable cutting structure having a second longitudinal length, wherein a ratio of the first longitudinal length of the first rotatable cutting structure and the second longitudinal length of the second rotatable cutting structure is within a range of 1.2 and 1.6.

* * * * *